US009471032B2

(12) United States Patent
Shiba

(10) Patent No.: US 9,471,032 B2
(45) Date of Patent: Oct. 18, 2016

(54) IMAGE FORMING APPARATUS WITH DEVELOPER RECOVERY CONTAINER

(71) Applicant: FUJI XEROX CO., LTD., Tokyo (JP)

(72) Inventor: Hiroki Shiba, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/885,155

(22) Filed: Oct. 16, 2015

(65) Prior Publication Data

US 2016/0274534 A1 Sep. 22, 2016

(30) Foreign Application Priority Data

Mar. 17, 2015 (JP) ..... 2015-053384

(51) Int. Cl.
*G03G 21/16* (2006.01)
*G03G 21/10* (2006.01)
*G03G 21/12* (2006.01)

(52) U.S. Cl.
CPC ..... *G03G 21/1676* (2013.01); *G03G 21/1647* (2013.01); *G03G 21/105* (2013.01); *G03G 21/12* (2013.01); *G03G 2221/1624* (2013.01)

(58) Field of Classification Search
CPC ..... G03G 2221/0052; G03G 2221/1624; G03G 21/12; G03G 21/105; G03G 21/007; G03G 21/1676
See application file for complete search history.

(56) References Cited

U.S. PATENT DOCUMENTS

2006/0193648 A1* 8/2006 Kadowaki ..... G03G 21/12 399/13
2011/0123207 A1* 5/2011 Sato ..... G03G 21/12 399/35
2011/0318026 A1* 12/2011 Kurimoto ..... G03G 21/12 399/35

FOREIGN PATENT DOCUMENTS

JP 2000-221863 A 8/2000
JP 2007-206596 A 8/2007

* cited by examiner

*Primary Examiner* — Sandra Brase
(74) *Attorney, Agent, or Firm* — Oliff PLC

(57) ABSTRACT

An image forming apparatus includes a developer recovery container having a rotatable member; an attachment structural section to which the container is detachably attached; and a rotation transmission mechanism disposed in the attachment structural section and connected to the rotatable member to transmit rotational driving force thereto when the container is attached. The mechanism includes a shaft extending in a direction of movement occurring when the container is attached and detached, a rotationally-driven stationary transmission member, a displacement transmission member attached to the shaft and rotationally shifting in an axial direction thereof in conjunction with the movement, and a moving member moving the displacement member toward the stationary member. The displacement member connects to and disconnects from the stationary member when the container is attached and detached, respectively. The container has a stopper that moves the moving member toward the stationary member when the container is attached.

5 Claims, 11 Drawing Sheets

IMAGE FORMING APPARATUS WITH DEVELOPER RECOVERY CONTAINER

CROSS-REFERENCE TO RELATED APPLICATIONS

This application is based on and claims priority under 35 USC 119 from Japanese Patent Application No. 2015-053384 filed Mar. 17, 2015.

BACKGROUND

Technical Field

The present invention relates to image forming apparatuses.

SUMMARY

According to an aspect of the invention, there is provided an image forming apparatus including a developer recovery container, an attachment structural section, and a rotation transmission mechanism. The developer recovery container has a rotatable member. The developer recovery container is detachably attached to the attachment structural section. The rotation transmission mechanism is disposed in one area of the attachment structural section and is connected to the rotatable member and transmits rotational driving force to the rotatable member when the developer recovery container is attached. The rotation transmission mechanism includes a shaft, a stationary transmission member, a displacement transmission member, and a moving member. The shaft extends in a direction of movement occurring when the developer recovery container is attached and detached. The stationary transmission member is disposed in a positionally fixed state and is rotationally driven. The displacement transmission member is attached to the shaft such that the displacement transmission member rotates and shifts in an axial direction of the shaft in conjunction with the movement occurring when the developer recovery container is attached and detached. The displacement transmission member shifts toward and connects to the stationary transmission member when the developer recovery container is attached. The displacement transmission member shifts away from and disconnects from the stationary transmission member when the developer recovery container is detached. The moving member moves the displacement transmission member toward the stationary transmission member. The developer recovery container has a stopper that comes into contact with the moving member and that moves the moving member toward the stationary transmission member when the developer recovery container is attached.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described below with reference to the appended drawings.

First Exemplary Embodiment

FIGS. 1 to 4 illustrate an image forming apparatus 1 according to a first exemplary embodiment.

Figure 1:
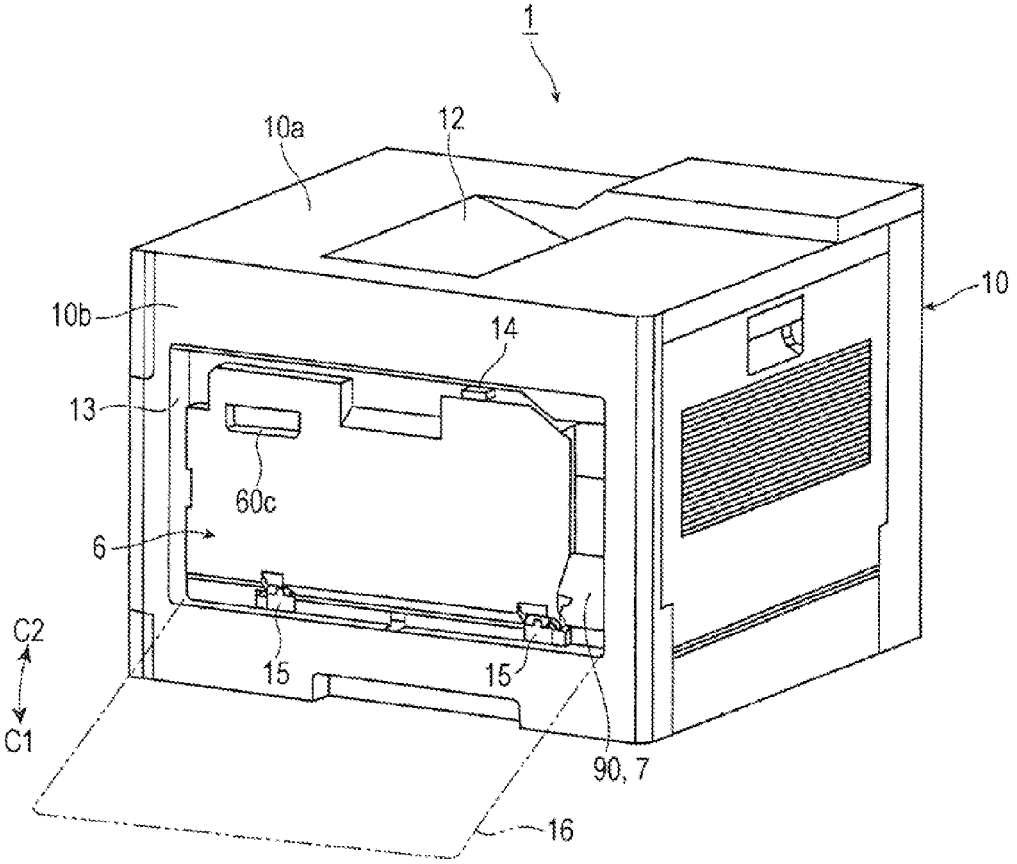
FIG. 1 is an external perspective view of an image forming apparatus according to a first exemplary embodiment (in a state where an external cover thereof is open)
Figure 2:
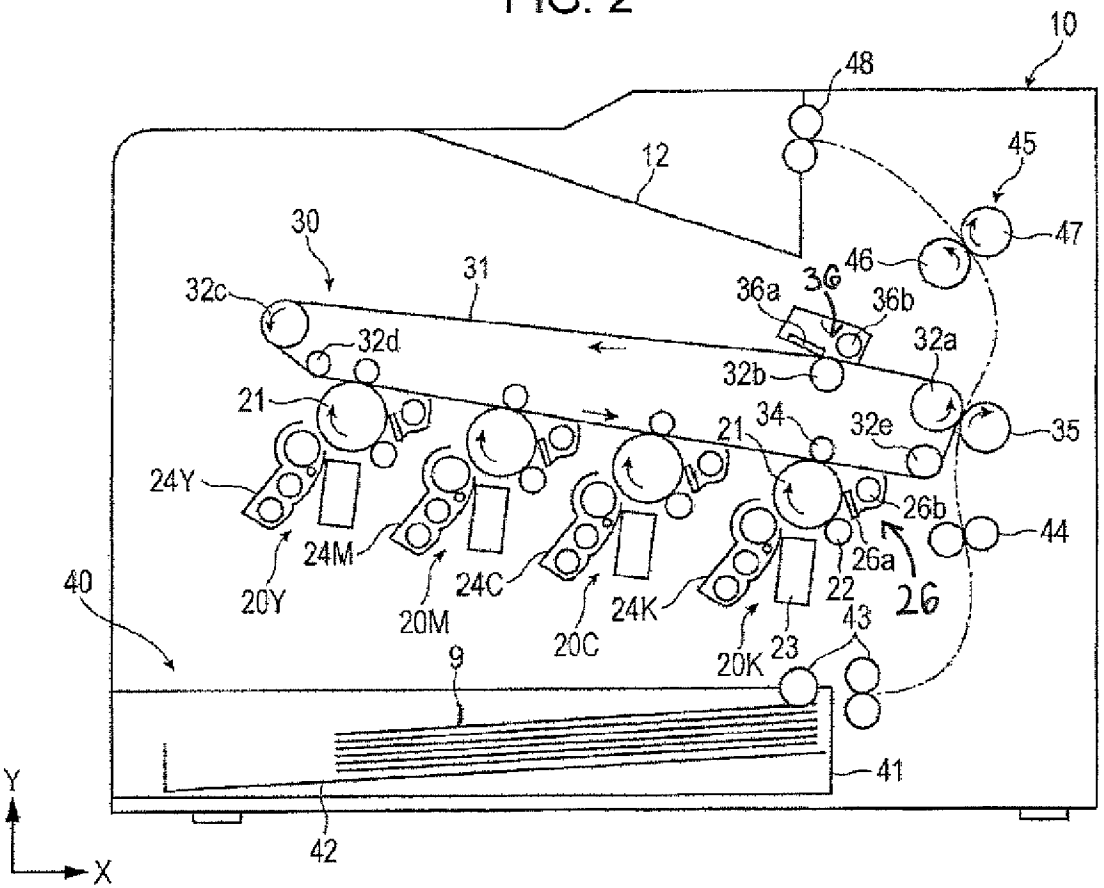
FIG. 2 schematically illustrates an internal configuration of the image forming apparatus in FIG. 1.
Figure 3:
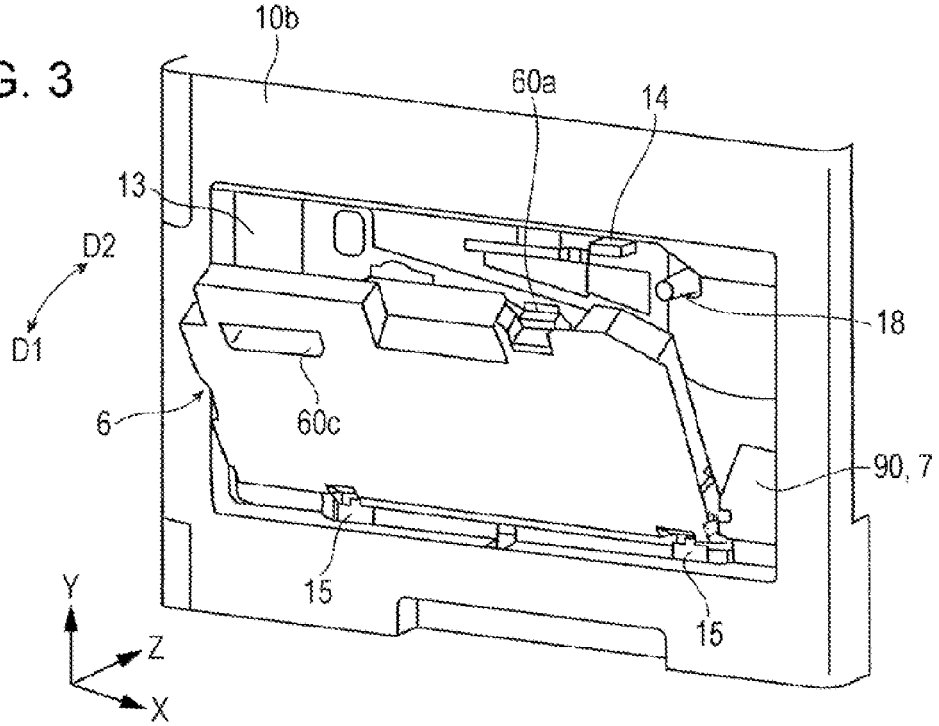
FIG. 3 is a partial perspective view illustrating a state where a developer recovery container is being attached to or detached from the image forming apparatus in FIG. 1.
Figure 4:
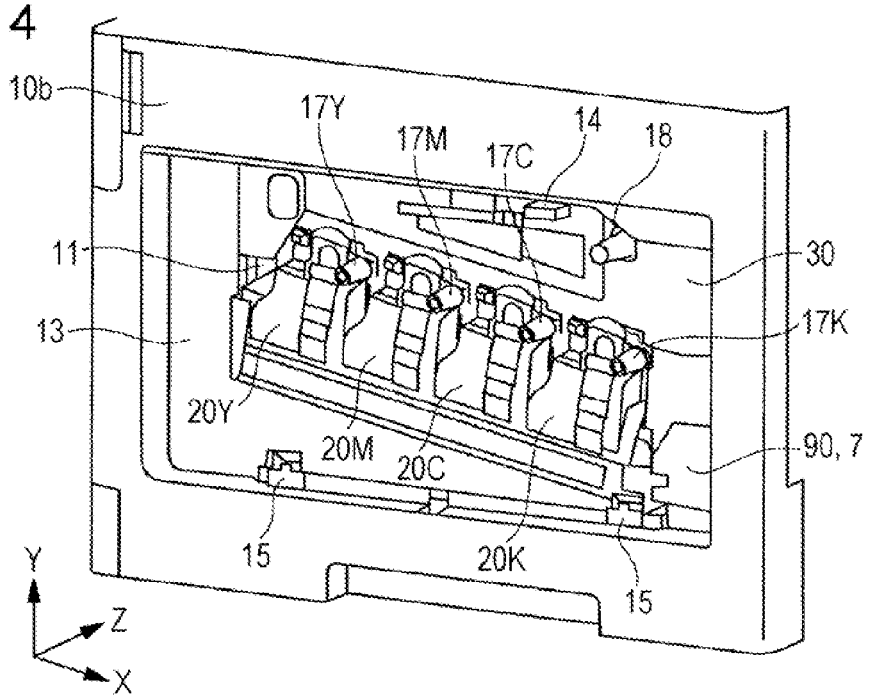
FIG. 4 is a partial perspective view illustrating a state where the developer recovery container is detached from the image forming apparatus in FIG. 1.

FIG. 1 is an external view of the image forming apparatus 1 (in a state where an external cover thereof is open), FIG. 2 illustrates an internal configuration of the image forming apparatus 1, FIG. 3 partially illustrates a process for attaching or detaching a developer recovery container to or from the image forming apparatus 1, and FIG. 4 partially illustrates a state where the developer recovery container is detached from the image forming apparatus 1. Arrows denoted by reference signs X, Y, and Z in FIG. 1 and so on are orthogonal coordinate axes indicating the width direction, the height direction, and the depth direction, respectively, in an assumed three-dimensional space.

Overall Configuration of Image Forming Apparatus

The image forming apparatus 1 according to the first exemplary embodiment forms an image constituted of a developer onto a recording sheet 9 as an example of a recording medium and serves as, for example, a printer that performs image formation by receiving image information input from an external device, such as an information terminal.

The image forming apparatus 1 has a housing 10 that is box-shaped in its entirety. As shown in FIG. 2, the internal space of the housing 10 has disposed therein, for example, image forming devices 20 that form toner images constituted of toners as developers; an intermediate transfer device 30 that carries and then transports the toner images, formed at the image forming devices 20 and first-transferred on the intermediate transfer device 30, and ultimately second-transfers the toner images onto the recording sheet 9; a sheet feed device 40 that accommodates the recording sheet 9 and delivers the recording sheet 9 to a second-transfer position of the intermediate transfer device 30; and a fixing device 45 that fixes the toner images second-transferred at the intermediate transfer device 30 onto the recording sheet 9. An upper surface 10*a* of the housing 10 is provided with an output accommodation section 12 onto which the recording sheet 9 having the image formed thereon is output and stacked. A dotted-chain line shown in FIG. 2 denotes a transport path for the recording sheet 9 within the housing 10.

The image forming devices 20 include four image forming devices 20Y, 20M, 20C, and 20K that individually form developer (toner) images of four respective colors, namely, yellow (Y), magenta (M), cyan (C), and black (K) colors. The image forming devices 20 (Y, M, C, and K) are arranged in the internal space of the housing 10 in an inclined state such that the positions thereof gradually increase in height in the following order: black, cyan, magenta, and yellow.

The four image forming devices 20 (Y, M, C, and K) each include a photoconductor drum 21 serving as a drum-type photoconductor that is rotationally driven in a direction indicated by an arrow (i.e., clockwise direction in FIG. 2); a roller-type charging device 22 that electrostatically charges an outer peripheral surface serving as an image forming region of the photoconductor drum 21 to a predetermined potential; an exposure device 23 that radiates light disassembled into the corresponding color component based on predetermined image information onto the electrostatically-charged outer peripheral surface of the photoconductor drum 21 so as to form an electrostatic latent image of the color component; a developing device 24 (Y, M, C, or K) that develops the electrostatic latent image by supplying the toner of the corresponding color component thereto so as to form a visible toner image of the corresponding color; and a drum cleaning device 26 that cleans the photoconductor drum 21 by removing waste, such as the toner remaining on the outer peripheral surface thereof, after the toner image on the photoconductor drum 21 is first-transferred onto an intermediate transfer belt 31 of the intermediate transfer device 30.

The developing devices 24 (Y, M, C, and K) respectively contain the toners of the color components corresponding to the aforementioned four colors (Y, M, C, and K) and are resupplied with developers (mostly toners) from developer suppliers (not shown) in accordance with information, such as consumed amounts thereof.

Each drum cleaning device 26 has a housing that accommodates therein, for example, a cleaning member 26*a* such as an elastic plate that scrapes off waste, such as residual toner, from the photoconductor drum 21 by coming into contact therewith, and a rotatable transport member 26*b* such a screw auger that transports the residual toner scraped off by the cleaning member 26*a* as waste toner toward a developer recovery container 6.

Furthermore, with regard to each of the image forming devices 20 (Y, M, C, and K), the photoconductor drum 21, the charging device 22, the developing device 24 (Y, M, C, or K), and the drum cleaning device 26 are supported by a common support frame and are integrated into a single unit. The entire unit is an attachable-detachable unit that is used by being detachably attached to a corresponding one of attachment structural sections 11 (FIG. 4) provided in the housing 10 of the image forming apparatus 1.

When each image forming device 20 (Y, M, C, or K) receives an image formation request, the charging device 22 electrostatically charges the outer peripheral surface of the rotating photoconductor drum 21 to a predetermined potential, and the exposure device 23 subsequently radiates light corresponding to an image signal of the corresponding color component onto the electrostatically-charged outer peripheral surface of the photoconductor drum 21, thereby forming an electrostatic latent image of the corresponding color component on the outer peripheral surface of the photoconductor drum 21. Then, the corresponding developing device 24 develops the electrostatic latent image of the corresponding color component formed on the outer peripheral surface of the photoconductor drum 21 by using the toner of the corresponding color (Y, M, C, or K). As a result, toner images of the four colors are formed on the respective photoconductor drums 21.

The intermediate transfer device 30 is disposed above the image forming devices 20 (Y, M, C, and K) in the gravitational direction in a slightly inclined state in correspondence with the inclined arranged state of the image forming devices 20.

The intermediate transfer device 30 includes, for example, an endless intermediate transfer belt 31 that carries and then transports the toner images, formed on the photoconductor drums 21 of the image forming devices 20 (Y, M, C, and K) and first-transferred on the intermediate transfer belt 31; multiple support rollers 32*a* to 32*e* that rotatably support the intermediate transfer belt 31 such that the intermediate transfer belt 31 sequentially pass through first-transfer positions of the image forming devices 20 (Y, M, C, and K); roller-type first-transfer devices 34 that are disposed within the intermediate transfer belt 31 and that generate a first-transfer effect for first-transferring the toner images formed on the photoconductor drums 21 of the image forming devices 20 (Y, M, C, and K) onto the outer peripheral surface of the intermediate transfer belt 31; a roller-type second-transfer device 35 that generates a second-transfer effect for second-transferring the toner images first-transferred on the intermediate transfer belt 31 onto the recording sheet 9; and a belt cleaning device 36 that cleans the intermediate transfer belt 31 by removing waste, such as the toners remaining on the outer peripheral surface thereof, after the second-transfer process.

The support roller 32*a* serves as a driving roller and a second-transfer backup roller, the support roller 32*c* serves as a tension applying roller, the support rollers 32*d* and 32*e* serve as leveling rollers, and the support roller 32*b* serves as a cleaning backup roller. The belt cleaning device 36 has a housing that accommodates therein, for example, a cleaning member 36*a* such as an elastic plate that scrapes off waste, such as residual toner, from the intermediate transfer belt 31 by coming into contact therewith, and a rotatable transport member 36*b* such a screw auger that transports the residual toner scraped off by the cleaning member 36*a* as waste toner toward the developer recovery container 6.

The sheet feed device 40 is disposed below the image forming devices 20 (Y, M, C, and K) in the gravitational direction.

The sheet feed device 40 includes a sheet accommodating body 41 that is attached to the housing 10 in an ejectable manner and that accommodates a stack of recording sheets 9 of a desired size and type on a stacking plate 42, and a delivery device 43 that delivers the recording sheets 9 one-by-one from the sheet accommodating body 41. During an image forming operation, the sheet feed device 40 causes the delivery device 43 to deliver a predetermined number of recording sheets 9 one-by-one from the sheet accommodating body 41. Each recording sheet 9 delivered from the sheet feed device 40 travels along the transport path denoted by the dotted-chain line and is ultimately transported to the second-transfer position (between the intermediate transfer belt 31 and the second-transfer device 35) of the intermediate transfer device 30 in accordance with a second-transfer timing by a pair of registration rollers 44 disposed in the transport path.

During the image forming operation, the toner images of the respective colors formed at the image forming devices 20 (Y, M, C, and K) are sequentially first-transferred in a positionally aligned state onto the outer peripheral surface of the intermediate transfer belt 31 in the intermediate transfer device 30 due to the first-transfer effect of the first-transfer devices 34. In this case, in the image forming devices 20 (Y, M, C, and K), the outer peripheral surfaces of the photoconductor drums 21 are cleaned by the drum cleaning devices 26 after the first-transfer process. Subsequently, the intermediate transfer belt 31 transports the first-transferred toner images to the second-transfer position facing the second-transfer device 35. Then, in the intermediate transfer device 30, the second-transfer effect of the second-transfer device 35 causes the toner images on the intermediate transfer belt 31 to be second-transferred onto the recording sheet 9 fed to the second-transfer position from the sheet feed device 40. In this case, in the intermediate transfer device 30, the outer peripheral surface of the intermediate transfer belt 31 is cleaned by the belt cleaning device 36 after the second-transfer process.

The fixing device 45 is disposed above a second-transfer section (i.e., an area where the second-transfer device 35 is in contact with the intermediate transfer belt 31) of the intermediate transfer device 30 in the gravitational direction.

The fixing device 45 has a housing that accommodates therein, for example, a roller-type or belt-type heating rotatable member 46 that is rotationally driven in a predetermined direction and whose surface temperature is maintained at a predetermined temperature by being heated by a heater, and a roller-type or belt-type pressing rotatable member 47 that substantially extends along the rotation axis of the heating rotatable member 46 and that is rotated by being in contact therewith with predetermined pressure.

During the image forming operation, the fixing device 45 transports the recording sheet 9 having the toner images second-transferred thereon at the intermediate transfer device 30 through a pressure contact section between the heating rotatable member 46 and the pressing rotatable member 47 so as to heat and press the recording sheet 9, thereby fusing and fixing the toner images onto the recording sheet 9. The recording sheet 9 after the fixing process travels along the transport path denoted by the dotted-chain line and is transported outside the housing 10 by a pair of output rollers 48 disposed in the transport path, so as to be ultimately output to and accommodated in the output accommodation section 12.

The image forming apparatus 1 may selectively actuate all of or some of the image forming devices 20 (Y, M, C, and K) (i.e., at least multiple-color toners) so as to be capable of forming a color image constituted of a combination of all of or some of the toners of the four colors (Y, M, C, and K). Furthermore, the image forming apparatus 1 may actuate one of the image forming devices 20 (Y, M, C, and K) so as to be capable of forming a single-color image constituted of a single-color toner, such as black toner.

Configuration Related to Developer Recovery

As shown in FIG. 2, in the image forming apparatus 1, the developers to be recovered after being scraped off and removed by the drum cleaning devices 26 in the four image forming devices 20 (Y, M, C, and K) and the belt cleaning device 36 in the intermediate transfer device 30 are ultimately collected and recovered by a single detachable-type developer recovery container 6.

Therefore, as shown in FIGS. 1 and 3, in the image forming apparatus 1, a first side surface 10*b* of the housing 10 is provided with an attachment structural section 13 for the developer recovery container 6. The attachment structural section 13 is recessed inward from the first side surface 10*b* by a predetermined depth. The developer recovery container 6 is used by being detachably attached to the attachment structural section 13. The first side surface 10*b* of the housing 10 is normally a side surface that is capable of partially exposing the four image forming devices 20 and the intermediate transfer device 30 to the outside.

The upper edge of the attachment structural section 13 for the developer recovery container 6 is partially provided with an upper support 14 that partially supports the upper portion of the developer recovery container 6 in a detachable manner when the developer recovery container 6 is attached. The lower edge of the attachment structural section 13 is partially provided with lower supports 15 that partially support the lower edge of the developer recovery container 6 such that the lower supports 15 may also be used as a rotation axis during the attaching-detaching operation. Additionally, the attachment structural section 13 is provided with an openable-closable outer cover 16 (FIG. 1) serving as a part of the housing 10. By opening and closing the outer cover 16 by rotating it in directions indicated by arrows C1 and C2 about its lower edge as an axis, the attachment structural section 13 is set in an externally exposed state and a covered state.

Furthermore, as shown in FIG. 4, in order to transport and drain the developers scraped off and removed by the drum cleaning devices 26 and the belt cleaning device 36 to the developer recovery container 6 attached to the attachment structural section 13, the image forming apparatus 1 is provided with developer drain pipes 17 (Y, M, C, and K) of the respective drum cleaning devices 26 and a developer drain pipe 18 of the belt cleaning device 36. The developer drain pipes 17 (Y, M, C, and K) and the developer drain pipe 18 protrude into the space in the attachment structural section 13. The developer drain pipes 17 (Y, M, C, and K) and the developer drain pipe 18 are each constituted of a cylindrical pipe body having a drain port for draining the developer to be recovered and a slide shutter that opens and closes the drain port by reciprocating within the pipe body in the lengthwise direction thereof.

Configuration of Detachable-Type Developer Recovery Container

Figure 5:
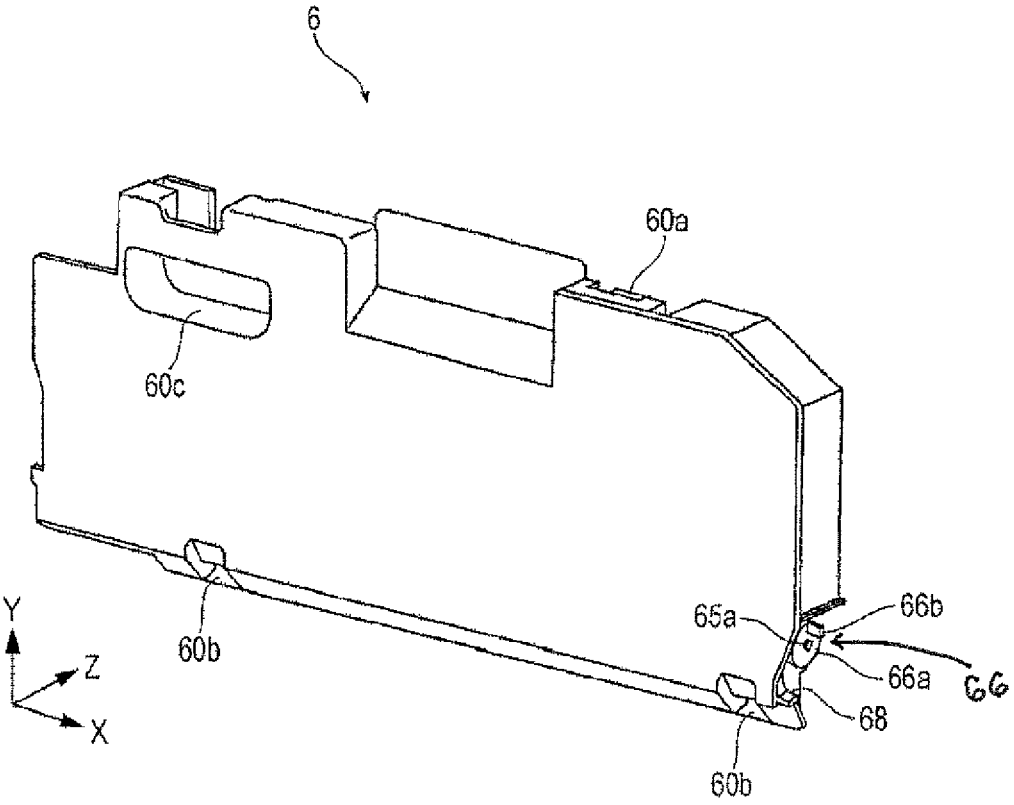
FIG. 5 is a perspective view illustrating the developer recovery container detachably attached to the image forming apparatus in FIG. 1, as viewed from the front side thereof.
Figure 6:
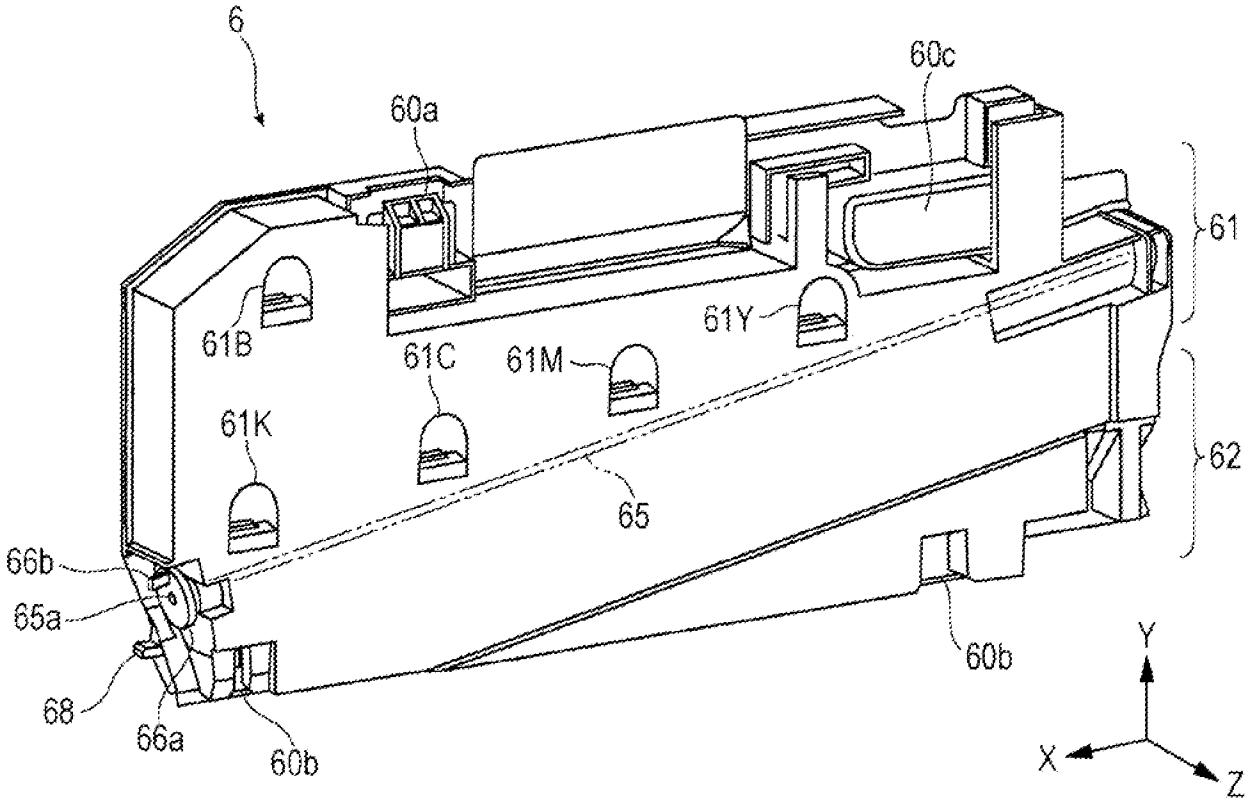
FIG. 6 is a perspective view illustrating the developer recovery container in FIG. 5, as viewed from the rear side thereof.

As shown in FIGS. 5 and 6, the developer recovery container 6 is a box-shaped container that has a predetermined space therein and that is like a substantially rectangular thick board that is long in its entirety in the transverse direction thereof.

The upper edge of the developer recovery container 6 is partially provided with a protrusion 60*a* that is detachably supported by the upper support 14 of the attachment structural section 13, and the lower edge of the developer recovery container 6 is partially provided with plate-shaped lower attachment portions 60*b* that are rotatably supported by the lower supports 15 of the attachment structural section 13. The front surface of the developer recovery container 6 is provided with a handle hole 60*c* that is recessed toward the rear surface.

The developer recovery container 6 is attached to and detached from the attachment structural section 13 of the image forming apparatus 1 in the following manner.

First, as shown in FIG. 3, when attaching the developer recovery container 6 to the attachment structural section 13 of the image forming apparatus 1, the developer recovery container 6 is entirely set in a tilted position, and the lower attachment portions 60*b* are inserted into the lower supports 15 of the attachment structural section 13. Then, the developer recovery container 6 is rotated in a direction indicated by an arrow D2 about the lower attachment portions 60*b* as an axis, and the protrusion 60*a* located at the upper edge is secured by being supported by the upper support 14 of the attachment structural section 13. Consequently, the developer recovery container 6 becomes attached to the attachment structural section 13 (see FIG. 1).

When detaching the developer recovery container 6 from the attachment structural section 13 of the image forming apparatus 1, the protrusion 60*a* located at the upper edge is released from the upper support 14 of the attachment structural section 13, and the upper edge is pulled frontward so that the developer recovery container 6 is rotated in a direction indicated by an arrow D1, whereby the developer recovery container 6 is entirely set in a tilted position (see FIG. 3). Then, the entire developer recovery container 6 is lifted diagonally frontward so as to remove the lower attachment portions 60*b* from the lower supports 15 of the attachment structural section 13. Consequently, the developer recovery container 6 becomes detached from the attachment structural section 13 (see FIG. 4).

Furthermore, as shown in FIGS. 5 and 6, the upper portion of the developer recovery container 6 is provided with connection sections 61 to be connected to the developer drain pipes 17 (Y, M, C, and K) of the respective drum cleaning devices 26 and to the developer drain pipe 18 of the belt cleaning device 36 when attaching the developer recovery container 6 to the attachment structural section 13 of the image forming apparatus 1. Moreover, the developer recovery container 6 is provided with an accommodation section 62 below the connection sections 61 (in the gravitational direction). The accommodation section 62 has a space for ultimately accommodating the developer drained from the drain ports of the developer drain pipes 17 (Y, M, C, and K) and the developer drain pipe 18.

The connection sections 61 include four connection sections 61Y, 61M, 61C, and 61K to be connected to the developer drain pipes 17 (Y, M, C, and K) of the respective drum cleaning devices 26 and a single connection section 61B to be connected to the developer drain pipe 18 of the belt cleaning device 36.

Each of the connection sections 61 (Y, M, C, and K) and 61B is a structural section having a connection port to which the pipe body of the corresponding developer drain pipe 17 or 18 is to be fitted and a storage space in which the pipe body is to be stored. Furthermore, in each of the connection sections 61 (Y, M, C, and K) and 61B, a bottom surface (which also serves as a partition plate separated from the accommodation section 62) within the storage space has a reception port for receiving the developer drained and dripping from the drain port of the corresponding developer drain pipe 17 or 18. Moreover, in each of the connection sections 61 (Y, M, C, and K) and 61B, the bottom surface having the reception port is provided with a rotatable shutter that opens and closes the reception port. The rotatable shutter rotationally moves parallel to the bottom surface having the reception port in conjunction with movement relative to the corresponding developer drain pipe 17 or 18, thereby opening and closing the reception port.

The accommodation section 62 has an accommodation space for accommodating a predetermined amount of developer drained and dripping from the drain ports of the developer drain pipes 17 and 18. The accommodation space is a single space connected to the reception ports of the connection sections 61 (Y, M, C, and K) and 61B.

Furthermore, the accommodation section 62 has disposed therein, for example, a rotatable transport member 65 (FIG. 6) such as a screw auger that rotates to even out and move the developer so as to reduce uneven deposition of the developer accommodated in the accommodation space, and a detector (not shown) for detecting that the amount of developer accommodated in the accommodation space has reached an amount set as an indication for replacing the developer recovery container 6.

The rotatable transport member 65 in the developer recovery container 6 is constituted of a rotation shaft and a transport blade formed helically around the rotation shaft. As shown in FIG. 6, the rotatable transport member 65 has a rotation shaft 65*a* that is provided within the accommodation space of the accommodation section 62 in a rotatable manner and in an inclined state in correspondence with the inclined arranged state of the connection sections 61Y, 61M, 61C, and 61K. In FIG. 6, the rotatable transport member 65 is shown with only the rotation shaft (65*a*) but not with the helical transport blade for the sake of convenience.

With regard to the rotatable transport member 65, a relatively lower end of the rotation shaft 65*a* is provided with a connection member 66 for connecting to a rotation transmission mechanism 7, which will be described below. As shown in FIGS. 5 and 6, the connection member 66 is constituted of a disk-shaped body 66*a* fixed to one end of the rotation shaft 65*a* of the rotatable transport member 65 and a connection protrusion 66*b* extending outward in the axial direction from a part of one surface of the body 66*a*. The connection protrusion 66*b* is, for example, plate-shaped. The connection member 66 is disposed in an externally exposed state in a recess formed in a lower portion of the developer recovery container 6.

Configuration of Rotation Transmission Mechanism

As shown in FIGS. 1, 3, 4, and 7, the image forming apparatus 1 includes the rotation transmission mechanism 7 at a lower end of the attachment structural section 13 for the developer recovery container 6. When the developer recovery container 6 is attached to the attachment structural section 13, the rotation transmission mechanism 7 is connected to the rotatable transport member 65 and transmits rotational driving force thereto.

Figure 7:
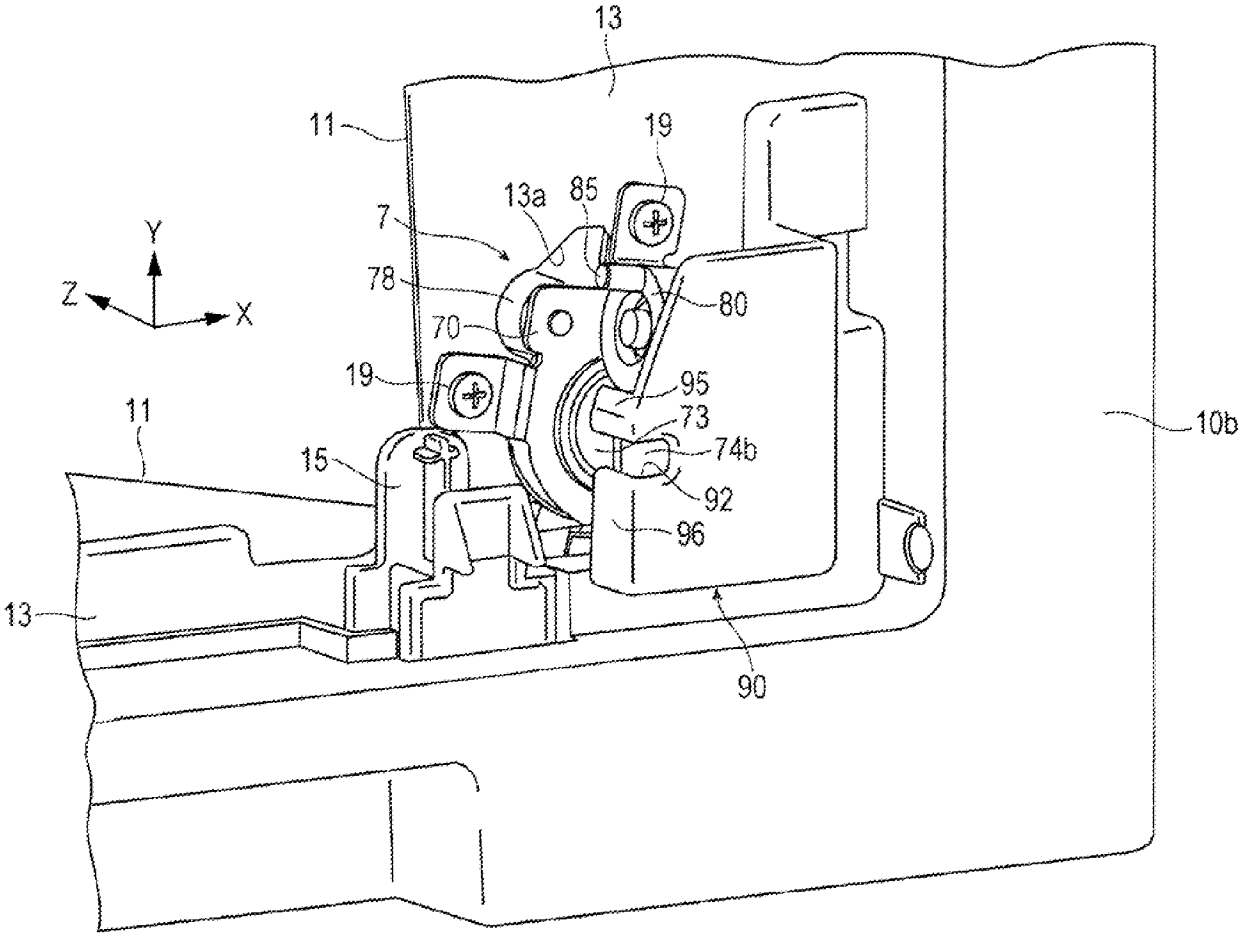
FIG. 7 is an enlarged perspective view illustrating the configuration of a rotation transmission mechanism and an attachment structural section for the developer recovery container in the image forming apparatus in FIG. 1.
Figure 8:
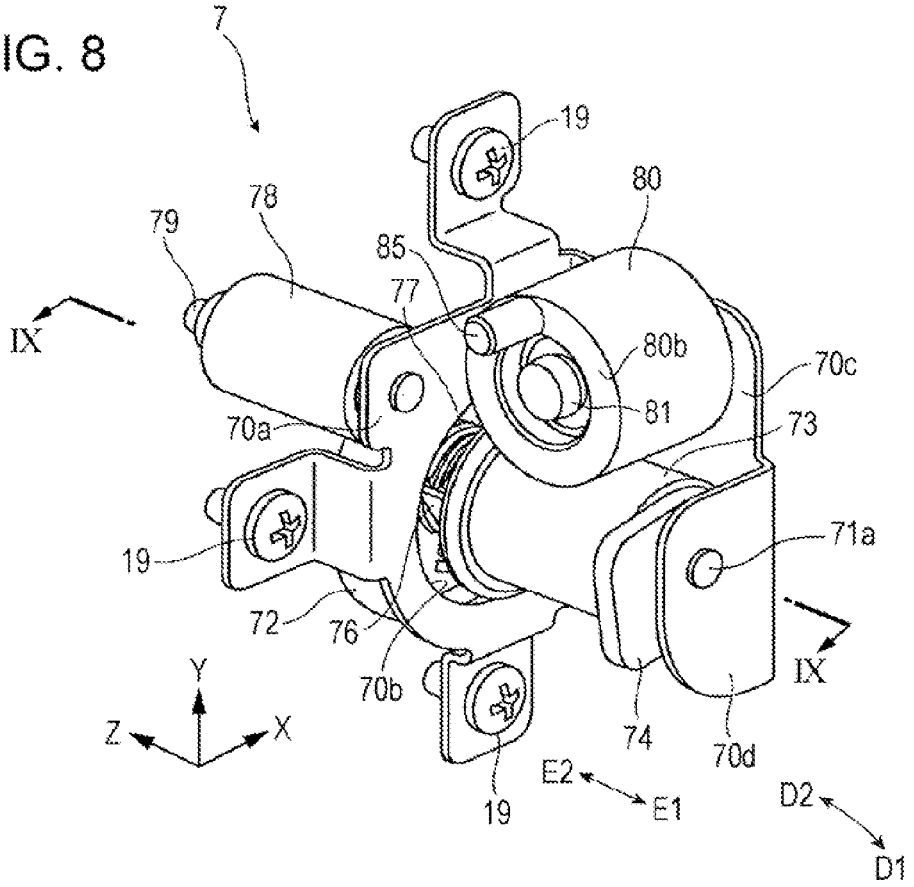
FIG. 8 is a perspective view illustrating the state of a relevant part of the rotation transmission mechanism in FIG. 7 (i.e., when a displacement gear is in a disconnected state)
Figure 9:
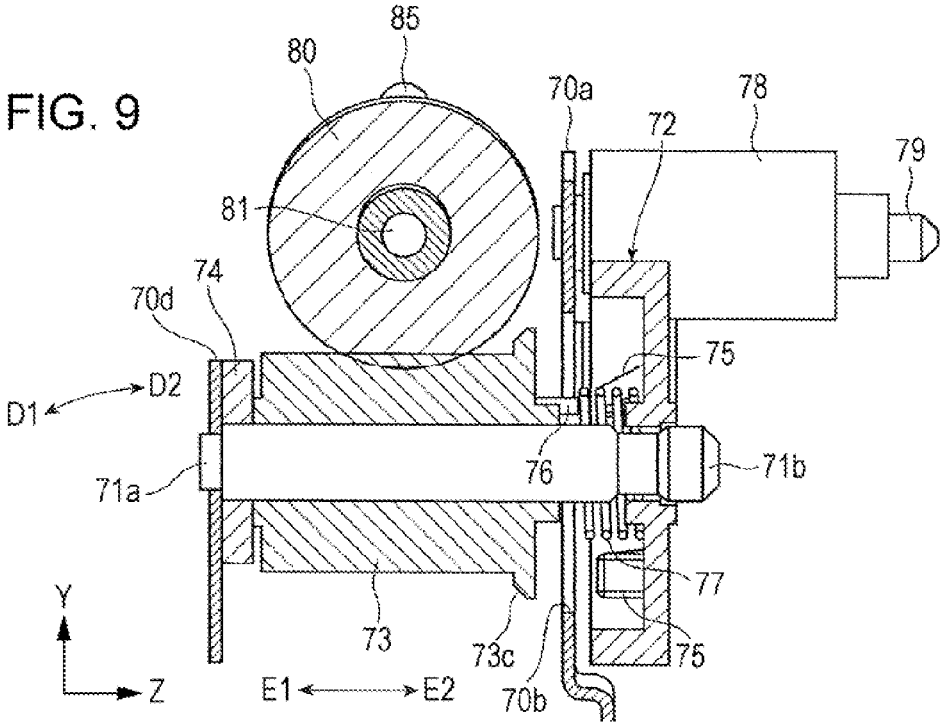
FIG. 9 is a cross-sectional view of the rotation transmission mechanism, taken along line IX-IX in FIG. 8.

As shown in FIGS. 7 to 9, the rotation transmission mechanism 7 includes, for example, a support frame 70 fixed to the attachment structural section 13 for the developer recovery container 6, a shaft 71 extending through the support frame 70 in directions D1 and D2 of movement occurring when the developer recovery container 6 is attached and detached, a first stationary gear 72 disposed in a rotatable manner while being positionally fixed to the support frame 70, a displacement gear 73 that is rotatably attached to the shaft 71 and is displaced in the axial direction of the shaft 71 (i.e., the direction parallel to the direction of the coordinate axis Z) in conjunction with movement occurring when the developer recovery container 6 is attached and detached, and a pressing plate 74 that causes the displacement gear 73 to move toward the shaft 71. In FIG. 7 and so on, the teeth of the gears are not shown.

The support frame 70 is a plate member formed to a predetermined shape for arranging and attaching the shaft 71, the first stationary gear 72, the displacement gear 73, and so on, and is fixed to the components constituting the attachment structural section 13 by using, for example, multiple screws 19. The support frame 70 in the first exemplary embodiment has a body 70*a* provided with a circular opening 70*b* with a size large enough for allowing the displacement gear 73 to pass through; a first bent surface 70*c* bent outward from the body 70*a* at a substantially right angle so as to ensure a space for disposing the shaft 71, the displacement gear 73, the pressing plate 74, and so on; and a second bent surface 70*d* bent so as to extend substantially parallel to the body 70*a* from the terminal end of the first bent surface 70*c* and also to face the opening 70*b*.

The shaft 71 is attached to the support frame 70 so as to extend in the directions D1 and D2 of movement occurring when the developer recovery container 6 is attached to and detached from the attachment structural section 13. To be exact, the directions D1 and D2 of movement occurring when the developer recovery container 6 is attached and detached in the first exemplary embodiment are directions that form a circular-arc line about an axis. However, because the movement directions D1 and D2 form a straight line when view from, for example, above or below in the gravitational direction, the linear motion is set as a reference for the position of the shaft 71. Therefore, the shaft 71 is disposed so as to extend in a direction in which it linearly reciprocates substantially in a horizontal state (i.e., the direction parallel to the direction of the coordinate axis Z) between the front side and the rear side of the image forming apparatus 1.

A columnar member having a predetermined length is used as the shaft 71. With regard to this shaft 71, a first end 71*a* thereof at the front side of the image forming apparatus 1 is securely attached to the second bent surface 70*d* of the support frame 70, and a second end 71*b* extends through the substantially central position of the opening 70*b* in the body 70*a* of the support frame 70 and protrudes to a position opposite the second bent surface 70*d* of the body 70*a* (FIG. 9).

The first stationary gear 72 is disposed so as to be located at a position opposite the second bent surface 70*d* of the body 70*a* of the support frame 70. Thus, the first stationary gear 72 is disposed so as not to be exposed to the outside due to the existence of the body 70*a*. In other words, the first stationary gear 72 is substantially covered by the body 70*a* of the support frame 70 so as to be substantially hidden from the outside.

Figure 10:
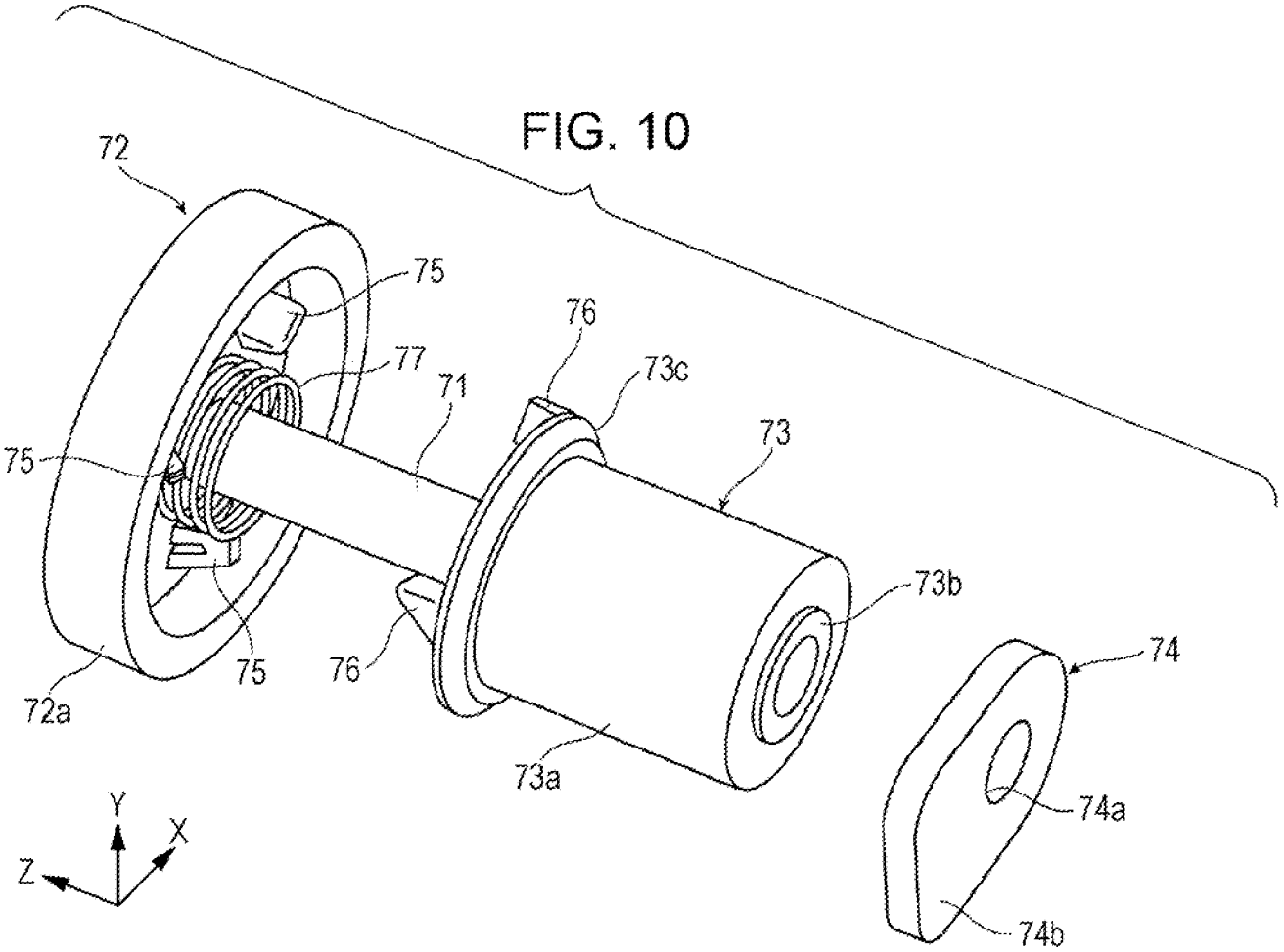
FIG. 10 is an exploded perspective view illustrating a shaft, a first stationary gear, and the displacement gear that constitute the rotation transmission mechanism.

Furthermore, as shown in FIGS. 9 and 10, the first stationary gear 72 is constituted of a disk-shaped gear body 72*a* whose central portion at one side thereof is recessed, and multiple connection protrusions 75 as shaft couplings provided in the recessed portion of the gear body 72*a* and protruding toward the displacement gear 73. Moreover, the first stationary gear 72 is rotatably attached to the second end 71*b* of the shaft 71 so as to rotate at a fixed position via a shaft bearing. Furthermore, the first stationary gear 72 is attached such that the surface thereof provided with the connection protrusions 75 faces the opening 70*b* in the body 70*a*.

The first stationary gear 72 meshes with a second stationary gear 78 attached to the body 70*a* of the support frame 70 and receives rotational driving force from the second stationary gear 78. The second stationary gear 78 is rotatably attached to a shaft 79 that is fixed to the same surface of the body 70*a* of the support frame 70 as the surface where the first stationary gear 72 is disposed. Furthermore, as shown in FIG. 7, the shaft 79 is connected, via an opening 13*a* provided in the attachment structural section 13, to a rotational driving device (not shown) disposed in the housing 10 of the image forming apparatus 1 and is rotationally driven by receiving rotational driving force from the rotational driving device.

The displacement gear 73 is located between the body 70*a* and the second bent surface 70*d* of the support frame 70. The displacement gear 73 is displaceable in directions indicated by arrows E1 and E2 relative to the shaft 71 and is attached rotatably around the shaft 71. With regard to the displacement gear 73, a portion thereof excluding the portion thereof covered by the first bent surface 70*c* and the second bent surface 70*d* of the support frame 70 is exposed to the outside. In other words, the displacement gear 73 has an exposed portion that is not covered by the support frame 70 and so on. Therefore, the body 70*a* of the support frame 70 serves as a partition member that is located between the first stationary gear 72 and the displacement gear 73. Specifically, the body 70*a* of the support frame 70 serving as the partition member does not expose the first stationary gear 72 to the outside but exposes the displacement gear 73 to the outside.

Furthermore, as shown in FIGS. 8 to 10, the displacement gear 73 is constituted of a columnar gear body 73*a* and multiple connection receiving protrusions 76 as shaft couplings protruding toward the first stationary gear 72 from an end of the gear body 73*a* that faces the first stationary gear 72. The displacement gear 73 is rotatably attached to the first end 71*a* of the shaft 71 via a shaft bearing 73*b* and is displaceable in the directions indicated by the arrows E1 and E2 which extend parallel to the axial direction of the shaft 71. The connection receiving protrusions 76 are provided on one surface of a flange 73*c* disposed at one end of the gear body 73*a* of the displacement gear 73 and having a diameter larger than that of the gear body 73*a*.

Furthermore, one end of the displacement gear 73 is elastically pressed away from the first stationary gear 72 (i.e., in the direction indicated by the arrow E1) by spring force of a coil spring 77 secured to the first stationary gear 72. In other words, unless the displacement gear 73 is pressed toward the first stationary gear 72, the displacement gear 73 is pressed away from the first stationary gear 72 (i.e., in the direction indicated by the arrow E1) by the spring force of the coil spring 77, so that the connection receiving protrusions 76 in the displacement gear 73 do not come into contact with the connection protrusions 75 in the first stationary gear 72 and are maintained out of connection with the connection protrusions 75 (i.e., in a disconnected state). As will be described later, when the displacement gear 73 is pressed by the pressing plate 74 toward the first stationary gear 72 (i.e., in the direction indicated by the arrow E2) against the spring force of the coil spring 77, the connection receiving protrusions 76 come into contact with the connection protrusions 75 in the first stationary gear 72 and are maintained in connection therewith (i.e., in a connected state).

The pressing plate 74 is attached to the shaft 71 in a displaceable manner in the directions indicated by the arrows E1 and E2 and presses against the displacement gear 73 in conjunction with the attaching operation of the developer recovery container 6, which will be described later, so as to move the displacement gear 73 toward the first stationary gear 72. As shown in FIG. 10, the pressing plate 74 is formed of a plate member having a predetermined shape, such as a trapezoidal shape with rounded corners in its entirety, and partially provided with an attachment hole 74*a* for attaching the pressing plate 74 in a displaceable manner to the shaft 71.

The pressing plate 74 is attached to the shaft 71 so as to be located between the displacement gear 73 and the second bent surface 70*d* of the support frame 70. Moreover, the pressing plate 74 is attached to the shaft 71 such that the pressing plate 74 is not in contact with the gear body 73*a* of the displacement gear 73 but is in contact with the shaft bearing 73*b* and such that a portion 74*b* thereof protrudes from the second bent surface 70*d* of the support frame 70. Alternatively, the pressing plate 74 may be attached by being bonded to the shaft bearing 73*b* of the displacement gear 73. Furthermore, the pressing plate 74 is pressed in the direction indicated by the arrow E2 by a pressing protrusion 68, which will be described later, in the developer recovery container 6.

As shown in FIGS. 1, 3, 4, 7, and 11, the rotation transmission mechanism 7 has disposed therein an intermediate gear 80 that rotates by meshing with the displacement gear 73 and that transmits its rotational driving force to the rotatable transport member 65 of the developer recovery container 6.

The intermediate gear 80 is rotatably attached to a shaft 81 whose one end is fixed substantially orthogonally to the first bent surface 70*c* of the support frame 70. In this case, the intermediate gear 80 is attached to the shaft 81 so as to face the connection member 66 in the developer recovery container 6 when the intermediate gear 80 is attached in a meshed state with the displacement gear 73. The shaft 81 is disposed substantially orthogonally to the shaft 71 to which the displacement gear 73 and so on are attached.

An end surface 80*b* of the intermediate gear 80 that is located opposite the first bent surface 70*c* is provided with a connection member 85 that is connectable to and disconnectable from the connection protrusion 66*b* of the connection member 66 in the developer recovery container 6. As shown in FIGS. 7 and 8, the connection member 85 serves as a connection receiving protrusion that protrudes outward in the axial direction of the shaft 81 from the end surface 80*b* of the intermediate gear 80. The connection member 85 may be of any type that comes into contact with the connection protrusion 66*b* of the connection member 66 in the developer recovery container 6 and that transmits rotational driving force thereto. In the first exemplary embodiment, the connection member 85 is columnar-shaped.

Figure 11:
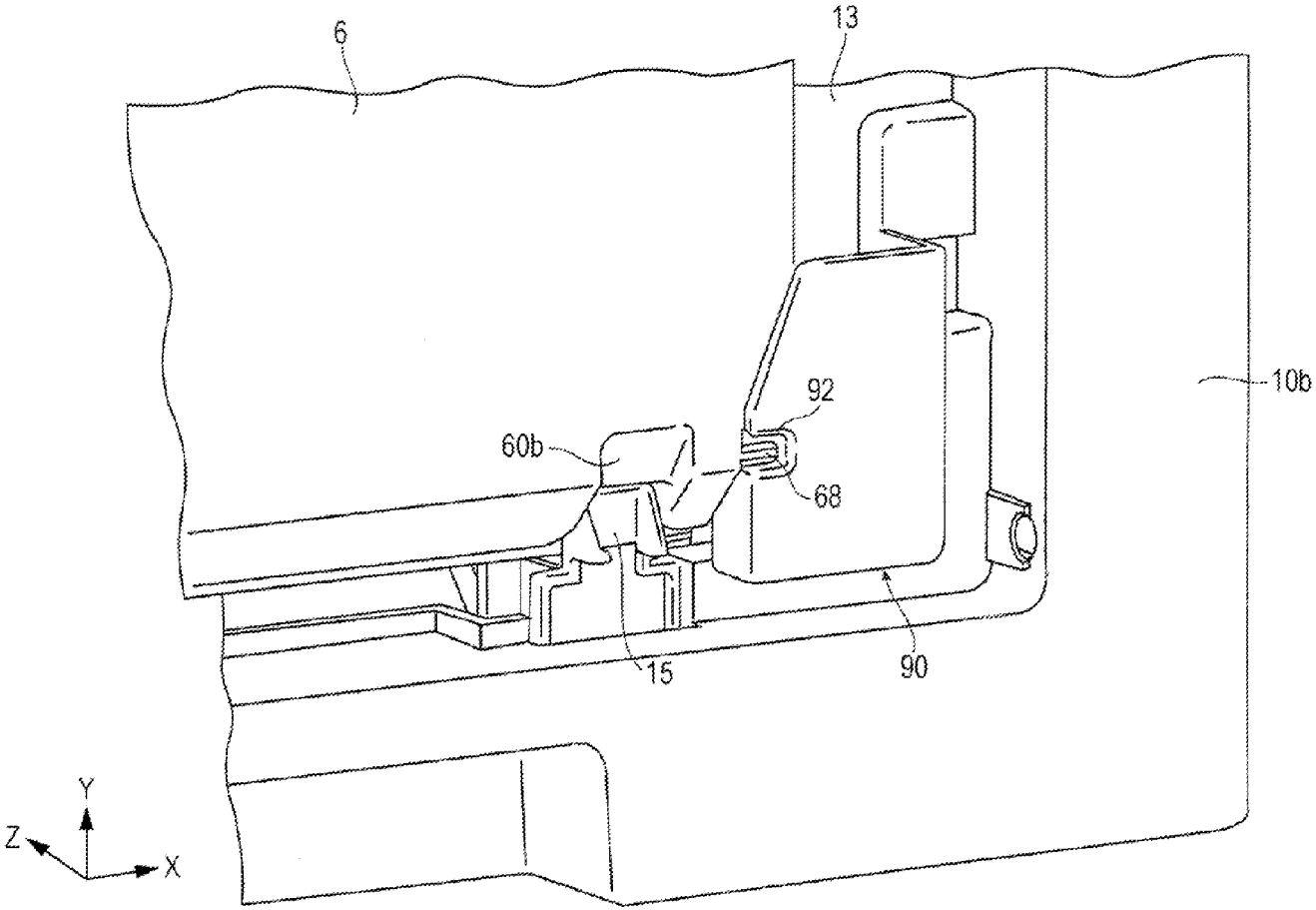
FIG. 11 is an enlarged perspective view illustrating a state where the developer recovery container is attached to the attachment structural section in the image forming apparatus in FIG. 1.

Furthermore, as shown in FIGS. 1, 7, and 11, the rotation transmission mechanism 7 includes a protection cover 90 for protecting some of the components of the rotation transmission mechanism 7 from the outside by covering them at the lower edge of the attachment structural section 13.

The protection cover 90 is formed of a component with a shape that covers the first bent surface 70*c* and the second bent surface 70*d* of the support frame 70 and that also partially covers the portion 74*b* of the pressing plate 74 that protrudes from the second bent surface 70*d*. Except for the fact that the displacement gear 73, the portion 74*b* of the pressing plate 74, and the end surface 80*b* of the intermediate gear 80, which are some of the components constituting the rotation transmission mechanism 7, are exposed to the outside, the protection cover 90 covers the remaining components from the outside. Moreover, the protection cover 90 is, for example, fixed by being attached to a part of a wall surface of the attachment structural section 13.

In order to allow the pressing protrusion 68, which will be described later, of the developer recovery container 6 to come into contact with and press against the protruding portion 74*b* of the pressing plate 74, the protection cover 90 is partially provided with a cutout 92 that exposes a part of the protruding portion 74*b* of the pressing plate 74 to the outside. Moreover, areas above and below the cutout 92 of the protection cover 90 are respectively provided with bent cover sections 95 and 96 that are bent so as to extend in the direction indicated by the arrow E2 corresponding to the displacement direction (i.e., the pressed direction) of the pressing plate 74. The bent cover sections 95 and 96 cover the protruding portion 74*b* of the pressing plate 74 so as not to expose the portion 74*b* to the outside. The cutout 92 is formed with a size small enough to keep, for example, an operator's finger away from the inside.

In the rotation transmission mechanism 7, for example, during an image forming operation as well as before and after the image forming operation, the rotational driving device (not shown) actuates and generates rotational driving force, and the rotational driving force is transmitted via the second stationary gear 78, whereby the first stationary gear 72 is rotationally driven. When performing an operation for opening the outer cover 16 or performing an attaching-detaching operation of the developer recovery container 6, the image forming apparatus 1 is not configured to perform control for forcedly stopping the rotation of the aforementioned rotational driving device (not shown), which transmits the rotational driving force to the rotation transmission mechanism 7, in conjunction with the operation.

On the other hand, as shown in FIGS. 5 and 11, in relation to the configuration of the rotation transmission mechanism 7, the developer recovery container 6 is provided with the pressing protrusion 68 that comes into contact with the protruding portion 74*b* of the pressing plate 74 in the rotation transmission mechanism 7 and that presses the pressing plate 74 toward the first stationary gear 72 when the developer recovery container 6 is being attached to the attachment structural section 13.

The pressing protrusion 68 is provided at the lower edge of the developer recovery container 6, where the connection member 66 of the rotatable transport member 65 is disposed, and has a size and shape that allow the pressing protrusion 68 to enter the cutout 92 of the protection cover 90 and to press against the pressing plate 74. Furthermore, when the developer recovery container 6 is attached to the attachment structural section 13, the pressing protrusion 68 is disposed at a position where the pressing protrusion 68 is capable of continuously pressing the protruding portion 74*b* of the pressing plate 74 toward the first stationary gear 72 by a predetermined distance in the direction indicated by the arrow E2.

Operations Related to Developer Recovery Container and Rotation Transmission Mechanism The operation of the rotation transmission mechanism 7 when attaching and detaching the developer recovery container 6 will be described below.

First, if the developer recovery container 6 is not attached to (i.e., detached from) the attachment structural section 13 of the image forming apparatus 1, the displacement gear 73, the intermediate gear 80, and the connection member 85 in the rotation transmission mechanism 7 disposed at the lower edge of the attachment structural section 13 are not covered by the support frame 70 and the protection cover 90 and are thus exposed to the outside of the attachment structural section 13, as shown in FIG. 7.

In this case, as shown in FIGS. 8 and 9, in the rotation transmission mechanism 7, the displacement gear 73 is elastically pressed in the direction indicated by the arrow E1 due to the spring force of the coil spring 77, so that the displacement gear 73 moves on the shaft 71 to a position located away from the first stationary gear 72. Thus, the connection receiving protrusions 76 in the displacement gear 73 are maintained out of connection (i.e., in a disconnected state) with the connection protrusions 75 in the first stationary gear 72.

As a result, in the rotation transmission mechanism 7, since the rotational driving force of the first stationary gear 72 is not transmitted to the displacement gear 73 even when the first stationary gear 72 is rotationally driven, the displacement gear 73 and the intermediate gear 80 are in a non-rotating state (i.e., a stopped state).

Therefore, when the developer recovery container 6 is not attached to the attachment structural section 13 in the image forming apparatus 1, safety may be ensured even if there is a possibility that the operator performing the attaching-detaching operation of the developer recovery container 6 may mistakenly touch the displacement gear 73, the intermediate gear 80, and so on exposed to the outside in the rotation transmission mechanism 7.

Subsequently, when the developer recovery container 6 is to be attached to the attachment structural section 13 of the image forming apparatus 1, the developer recovery container 6 is entirely set in a tilted position, and the lower attachment portions 60*b* are inserted into the lower supports 15 of the attachment structural section 13, as described above (see FIG. 3). Then, the developer recovery container 6 is rotated upward in the direction indicated by the arrow D2 about the lower attachment portions 60*b* as an axis, and the protrusion 60*a* located at the upper edge is secured by being supported by the upper support 14 of the attachment structural section 13.

In the process of attaching the developer recovery container 6, as shown in FIG. 11, the pressing protrusion 68 moves in the direction indicated by the arrow D2 in conjunction with the rotating motion of the developer recovery container 6 in the direction indicated by the arrow D2, so that the pressing protrusion 68 comes into contact with the protruding portion 74*b* of the pressing plate 74 after passing through the cutout 92 in the protection cover 90 of the rotation transmission mechanism 7, whereby the pressing plate 74 is pressed toward the first stationary gear 72.

Consequently, as shown in FIGS. 11 to 14, in the rotation transmission mechanism 7, the displacement gear 73 is pressed by the pressing plate 74 and moves on the shaft 71 in the direction indicated by the arrow E2 against the spring force of the coil spring 77 to a position close to the first stationary gear 72. Thus, the connection receiving protrusions 76 in the displacement gear 73 come into contact with the connection protrusions 75 in the first stationary gear 72 and are maintained in connection therewith (i.e., in a connected state).

Figure 12:
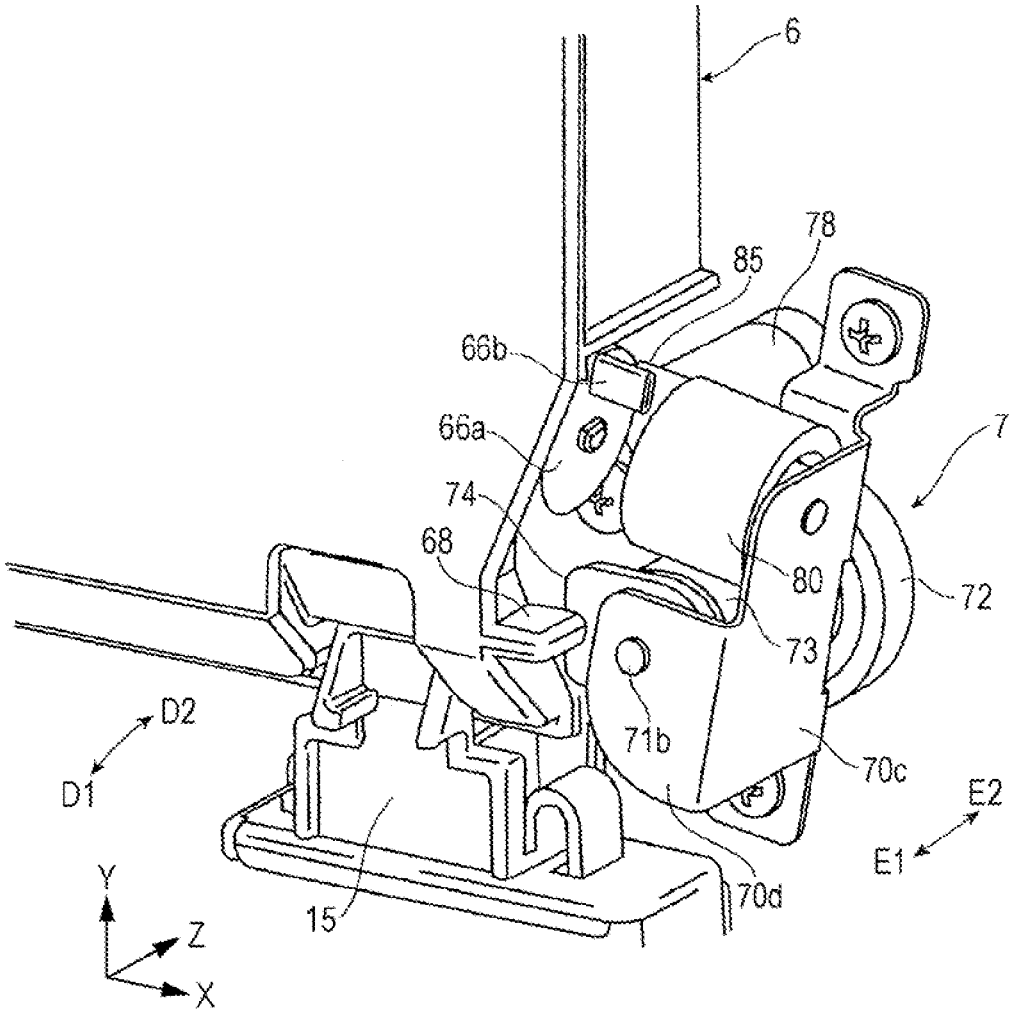
FIG. 12 is an enlarged perspective view illustrating the state of the developer recovery container and the rotation transmission mechanism when the developer recovery container is attached to the attachment structural section.
Figure 13:
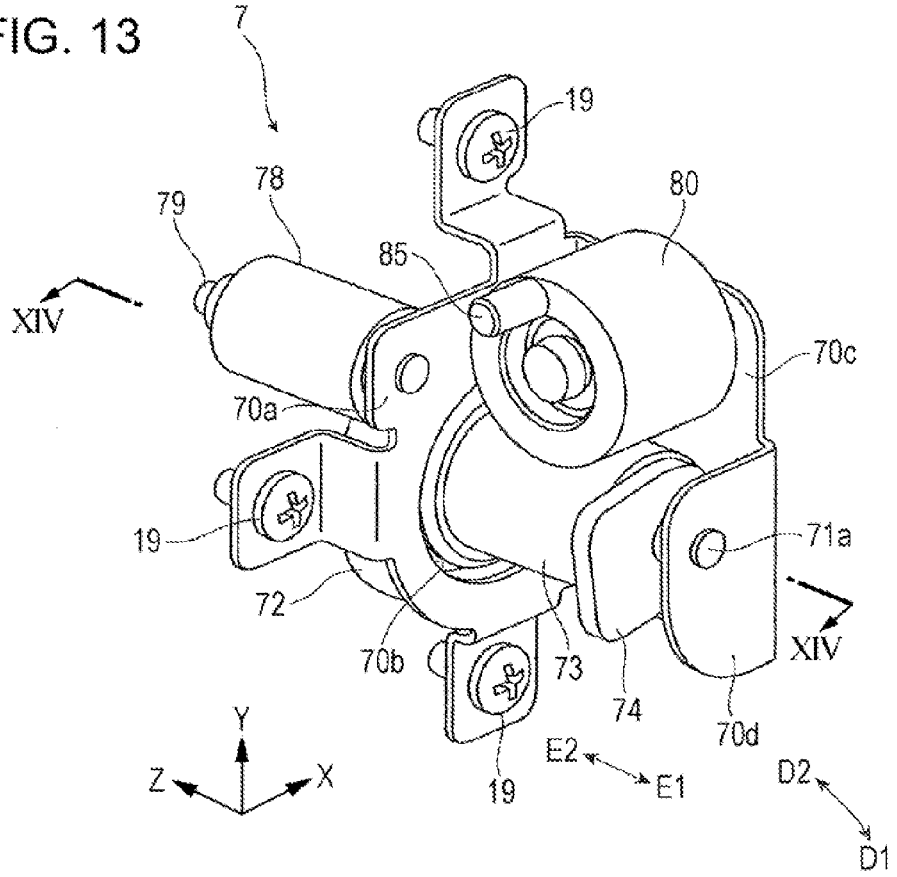
FIG. 13 is a perspective view illustrating the state of the relevant part of the rotation transmission mechanism in FIG. 12 (i.e., when the displacement gear is in a connected state)
Figure 14:
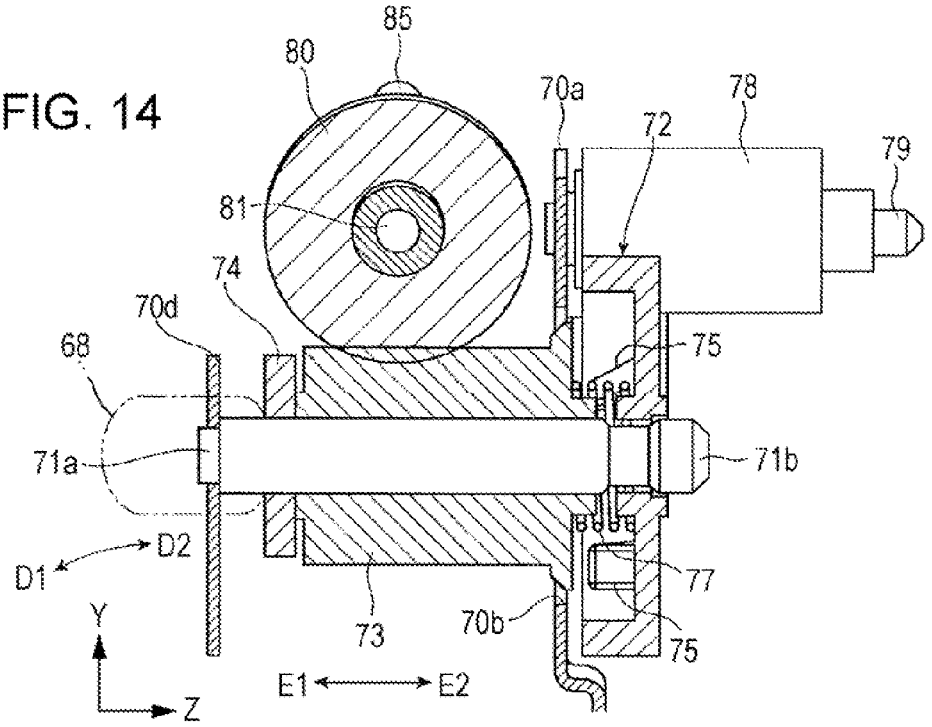
FIG. 14 is a cross-sectional view illustrating the rotation transmission mechanism, taken along line XIV-XIV in FIG. 13.

Just before the developer recovery container 6 becomes attached to the attachment structural section 13, the connection protrusion 66*b* of the connection member 66 in the rotatable transport member 65 of the developer recovery container 6 comes into contact with the connection member 85 of the intermediate gear 80 in the rotation transmission mechanism 7 so as to become connected therewith (see FIG. 12).

As a result, in the rotation transmission mechanism 7, the rotational driving force from the first stationary gear 72 is transmitted to the displacement gear 73, so that the intermediate gear 80 connected (meshed) with the displacement gear 73 is rotationally driven. In the developer recovery container 6, the rotational driving force of the intermediate gear 80 is transmitted to the rotatable transport member 65 via the connection member 66, so that the rotatable transport member 65 is rotationally driven within the accommodation section 62.

As shown in FIGS. 1 and 11, in the state where the developer recovery container 6 is attached to the attachment structural section 13, the displacement gear 73, the intermediate gear 80, and the connection member 85 that are previously exposed to the outside in the rotation transmission mechanism 7 become hidden due to the existence of the developer recovery container 6 so as to become not exposed to the outside.

Therefore, in the image forming apparatus 1, the displacement gear 73 in the rotation transmission mechanism 7 may be efficiently connected to the first stationary gear 72 in conjunction with the attaching operation of the developer recovery container 6, thereby setting the rotation transmission mechanism 7 in a state where it is capable of transmitting the rotational driving force. In addition, the connection member 66 of the rotatable transport member 65 in the developer recovery container 6 may be connected to the rotatable transport member 65 of the intermediate gear 80 in the rotation transmission mechanism 7 in conjunction with the attaching operation of the developer recovery container 6, thereby setting the rotatable transport member 65 in a rotationally drivable state.

Subsequently, when the developer recovery container 6 is to be detached from the attachment structural section 13 of the image forming apparatus 1, the protrusion 60*a* of the developer recovery container 6 is released from the upper support 14 of the attachment structural section 13, and the upper edge of the developer recovery container 6 is pulled frontward so that the entire developer recovery container 6 is rotated in the direction indicated by the arrow D1 and is set in a tilted position (see FIG. 3), as described above. Then, the entire developer recovery container 6 is lifted diagonally frontward so as to remove the lower attachment portions 60*b* from the lower supports 15 of the attachment structural section 13 (see FIG. 4).

In the process of detaching the developer recovery container 6, the pressing protrusion 68 moves in the direction indicated by the arrow D1 in conjunction with the rotating motion of the developer recovery container 6 in the direction indicated by the arrow D1, so that the pressing protrusion 68 moves out of contact with the protruding portion 74*b* of the pressing plate 74 in the rotation transmission mechanism 7 and subsequently moves outward by passing through the cutout 92 in the protection cover 90. Thus, the displacement gear 73 is released from the pressing effect by the pressing plate 74 and is simultaneously pressed by receiving the spring force of the coil spring 77, so that the displacement gear 73 moves on the shaft 71 to a position located away from the first stationary gear 72.

In the process of performing this detaching operation, the connection member 66 of the rotatable transport member 65 in the developer recovery container 6 is separated (i.e., into a disconnected state) from the connection member 85 of the intermediate gear 80 in the rotation transmission mechanism 7.

Furthermore, when the developer recovery container 6 is detached from the attachment structural section 13, the displacement gear 73, the intermediate gear 80, and the connection member 85 in the rotation transmission mechanism 7 previously hidden due to the existence of the developer recovery container 6 become exposed to the outside (FIG. 7).

Thus, as shown in FIGS. 8 and 9, in the rotation transmission mechanism 7, the connection receiving protrusions 76 in the displacement gear 73 displaced in the direction indicated by the arrow E1 are maintained out of connection (i.e., in a disconnected state) with the connection protrusions 75 in the first stationary gear 72. As a result, in the rotation transmission mechanism 7, since the rotational driving force of the first stationary gear 72 is not transmitted to the displacement gear 73 even when the first stationary gear 72 is rotationally driven, the displacement gear 73 and the intermediate gear 80 are in a non-rotating state (i.e., a stopped state).

Therefore, when the developer recovery container 6 is being detached from the attachment structural section 13 in the image forming apparatus 1, safety may be ensured even if there is a possibility that the operator performing the attaching-detaching operation of the developer recovery container 6 may mistakenly touch the displacement gear 73, the intermediate gear 80, and so on exposed to the outside in the rotation transmission mechanism 7. Moreover, supposing that the recovered developer drips from, for example, the developer recovery container 6 toward the rotation transmission mechanism 7, since the body 70*a* of the support frame 70 covers and hides the first stationary gear 72 and so on from the outside, a portion of the recovered developer may be prevented from entering the housing 10 of the image forming apparatus 1 via a part of the rotation transmission mechanism 7.

Furthermore, as described above, when performing an operation for opening the outer cover 16 or performing an attaching-detaching operation of the developer recovery container 6, the image forming apparatus 1 is not configured to perform control for forcedly stopping the rotation of the rotational driving device (not shown), which transmits the rotational driving force to the rotation transmission mechanism 7, in conjunction with the operation. Even so, the connection and disconnection between the rotatable transport member 65 of the developer recovery container 6 and the rotation transmission mechanism 7 in the attachment structural section 13 may be performed efficiently and safely. Consequently, the image forming apparatus 1 provides an option for omitting a relatively expensive detector (such as a detection sensor) for detecting the opening operation of the outer cover 16 or the attaching-detaching operation of the developer recovery container 6. In the case where such a detector is omitted, cost reduction may be achieved.

Furthermore, in the image forming apparatus 1, a large-scale component does not have to be disposed in the area where the connection and disconnection between the rotatable transport member 65 of the developer recovery container 6 and the rotation transmission mechanism 7 in the attachment structural section 13 are performed, and an additional installation space for disposing such a component does not have to be ensured, so that the area where the connection and disconnection are performed may be made compact.

Other Exemplary Embodiments

In the first exemplary embodiment, the first stationary gear 72 in the rotation transmission mechanism 7 is attached together with the displacement gear 73 to the shaft 71 as an example. Alternatively, the first stationary gear 72 may be attached to another shaft that is disposed separately from the shaft 71.

In that case, the other shaft is disposed so as to extend in the same direction as the shaft 71 and also to face the shaft 71. Moreover, the other shaft in that case may be provided in, for example, a part of the support frame 70 or a component constituting the attachment structural section 13.

Furthermore, in the first exemplary embodiment, the protection cover 90 that partially covers the rotation transmission mechanism 7 is provided as an example. Alternatively, the protection cover 90 may be omitted. In order to partially expose the pressing plate 74 in the rotation transmission mechanism 7 to the outside, the protection cover 90 may have a through-hole having a predetermined opening shape in place of the cutout 92 described as an example in the first exemplary embodiment.

In this case, the pressing protrusion 68 as a stopper in the developer recovery container 6 has to be a protrusion with a shape and size that avoid contact with the protection cover 90 while being capable of passing through the through-hole to come into contact with a part of the pressing plate 74 during the attaching operation of the developer recovery container 6. Moreover, in this case, the pressing plate 74 as a moving member in the rotation transmission mechanism 7 may be omitted, and the pressing protrusion 68 in the developer recovery container 6 may be configured to come into contact with and press against the shaft bearing 73*b* of the displacement gear 73.

Furthermore, in the first exemplary embodiment, the developer recovery container 6 is of a type that is attached and detached by being rotationally moved relative to the attachment structural section 13 of the image forming apparatus 1. Alternatively, for example, the developer recovery container 6 may be of a type that is attached and detached by being moved substantially linearly relative to the attachment structural section 13 of the image forming apparatus 1.

In a case where the image forming apparatus according to an exemplary embodiment of the present invention is of a type that is capable of forming a color image, the image forming apparatus may be of a type that does not use an intermediate transfer device (i.e., a so-called direct transfer type that transports a recording sheet to make the recording sheet pass through the first-transfer positions at the image forming devices and that directly transfers toner images onto the recording sheet). Furthermore, the image forming apparatus according to an exemplary embodiment of the present invention may be of a type that forms a single-color image, such as a monochrome image.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a developer recovery container that has a rotatable member;

an attachment structural section to which the developer recovery container is detachably attached; and a rotation transmission mechanism that is disposed in one area of the attachment structural section and that is connected to the rotatable member and transmits rotational driving force to the rotatable member when the developer recovery container is attached, wherein the rotation transmission mechanism includes a shaft that extends in a direction of movement occurring when the developer recovery container is attached and detached, a stationary transmission member that is disposed in a positionally fixed state and that is rotationally driven, a displacement transmission member that is attached to the shaft such that the displacement transmission member rotates and shifts in an axial direction of the shaft in conjunction with the movement occurring when the developer recovery container is attached and detached, the displacement transmission member shifting toward and connecting to the stationary transmission member when the developer recovery container is attached, the displacement transmission member shifting away from and disconnecting from the stationary transmission member when the developer recovery container is detached, and a moving member that moves the displacement transmission member toward the stationary transmission member, and wherein the developer recovery container has a stopper that comes into contact with the moving member and that moves the moving member toward the stationary transmission member when the developer recovery container is attached.

2. The image forming apparatus according to claim 1, wherein the rotation transmission mechanism has an intermediate transmission member that is provided with a disconnectable first connection member disposed in a positionally fixed state and that rotates by connecting to the displacement transmission member, and wherein the rotatable member of the developer recovery container is provided with a second connection member that is connectable to and disconnectable from the first connection member of the intermediate transmission member when the developer recovery container is attached and detached.

3. The image forming apparatus according to claim 1, wherein the stationary transmission member is constituted of a disconnectable first shaft coupling and a stationary gear provided with the first shaft coupling, and wherein the displacement transmission member is constituted of a second shaft coupling, which is connectable to and disconnectable from the first shaft coupling of the stationary transmission member, and a displacement gear provided with the second shaft coupling.

4. The image forming apparatus according to claim 1, wherein a partition member is disposed between the stationary transmission member and the displacement transmission member such that the partition member does not expose the stationary transmission member to outside and exposes the displacement transmission member to the outside.

5. The image forming apparatus according to claim 1, further comprising:

a cover member that is opened and closed so as to expose the attachment structural section to outside and to cover and hide the attachment structural section, wherein the image forming apparatus is not configured to perform control for stopping rotation of the rotation transmission mechanism in conjunction with an opening operation of the cover member.

* * * * *